United States Patent [19]

Nagasaka et al.

[11] 4,195,607

[45] Apr. 1, 1980

[54] BLOW-BY GAS RECIRCULATING DEVICE

[75] Inventors: Yasumasa Nagasaka, Okazaki; Haruki Furukawa, Toyota; Takao Maeda, Kariya; Masatsugu Tsukatani, Toyota, all of Japan

[73] Assignee: Toyota Jidosha Kogyo Kabushiki Kaisha, Toyota, Japan

[21] Appl. No.: 940,296

[22] Filed: Sep. 7, 1978

[30] Foreign Application Priority Data

Mar. 27, 1978 [JP] Japan ..... 53-34106

[51] Int. Cl.[2] ..... F02M 25/06

[52] U.S. Cl. ..... 123/119 B

[58] Field of Search ..... 123/119 B, 119 D, 119 DB, 123/124 R, 119 A

[56] References Cited

U.S. PATENT DOCUMENTS

| | | | |
|---|---|---|---|
| 2,986,132 | 5/1961 | Matz | 123/119 B |
| 3,059,628 | 10/1962 | Linn | 123/119 B |
| 3,123,060 | 3/1964 | Daigh | 123/119 B |
| 3,176,670 | 4/1965 | Sinibaldi | 123/119 B |
| 3,242,915 | 3/1966 | Blacker | 123/119 B |
| 3,547,090 | 12/1970 | Seliger | 123/119 B |
| 3,557,763 | 1/1971 | Probst | 123/119 B |
| 3,946,710 | 3/1976 | Albano et al. | 123/119 B |
| 3,961,616 | 6/1976 | Brown | 123/119 B |
| 3,973,534 | 8/1976 | Amos | 123/119 B |

*Primary Examiner*—Wendell E. Burns
*Attorney, Agent, or Firm*—Finnegan, Henderson, Farabow, Garrett & Dunner

[57] ABSTRACT

A blow-by gas recirculating device includes an inlet pipe in communication with the intake passage for an automobile engine, and a heat-insulating member. Particularly, the inlet pipe communicates between a blow-by gas producing source and a heat-insulating member positioned between a carburetor and an intake manifold, all forming part of an intake system for the engine. The heat-insulating member has two intake through-holes which form part of the intake passage for the engine and an inlet-pipe-admitting hole which extends from the outer side-surface of the member to the peripheral surface of one of the intake through-holes. The inlet pipe, one end of which is disposed in the inlet-pipe-admitting hole, has an average coefficient of linear expansion of no less than $16.7\times10^{-6}$/deg. in a temperature range of $-20°$ to $200°$ C., and a modulus of longitudinal elasticity of no more than 12980 kg/mm$^2$. The end of the inlet pipe is positioned in the inlet-pipe-admitting hole and an adhesive is applied. The blow-by gas producing source may comprise the crank case or a cylinder head cover. In the latter case, the positive crank-case ventilating pipe connects the cylinder head cover to the intake system for the engine.

7 Claims, 6 Drawing Figures

BLOW-BY GAS RECIRCULATING DEVICE

BACKGROUND OF THE INVENTION

This invention relates to a blow-by gas-recirculating or returning device, and more particularly to an inlet pipe for introducing a blow-by gas into the intake system of an automotive engine and to a heat-insulating member interposed between the carburetor and intake manifold of the engine to which the pipe is connected.

It has been a common practice to provide a heat-insulating member between a carburetor and an intake manifold, and an inlet pipe in communication with a source of blow-by gas and an intake passage defined in part by the heat-insulating member for returning or recirculating blow-by gas from a crank case to the intake system of an automotive engine. The heat-insulating member serves to prevent the transfer of heat from the engine, e.g., a thermal reactor or the like, to the carburetor.

When fabricating recirculating devices of this type, the inlet pipe is conventionally built into the heat-insulating member. To accomplish that, the inlet pipe is placed in a cavity in a metal mold through a hole provided in the mold. Heat-insulating material of a given fluidity is then poured into a cavity outside the inlet pipe which serves as an insert in the molding process. The insulating material is then allowed to cure or harden with the result that the inlet pipe is rigidly positioned in the heat-insulating member thus molded. However, the inlet pipe must be tightly fitted in the hole in the metal mold so as to prevent leakage of the fluid heat-insulating material from the metal mold. This necessitates machining the inlet pipe to high accuracy with consequent additional labor and expense. In addition, there arises another drawback in this insert-molding process in that the insulating material is likely to clog at the entrance of the inlet pipe. Further, there is great difficulty in providing a suitable bend to the inlet pipe after the inlet pipe and heat-insulating member are molded.

An alternative approach, and one which was desirable from a cost standpoint, was to utilize an inlet pipe formed of zinc-plated steel. However, a zinc-plated-steel inlet pipe is difficult to utilize in the aforenoted insert-molding process, because of poor dimensional accuracy. Consequently, the pipe must be affixed to the heat-insulating member with an adhesive. This leads to still another drawback in that an adhesive which is capable of withstanding high temperatures tends to create cracking on the bonding interface of the adhesive and the pipe. This has been demonstrated when the adhesive was subjected to a thermal shock test conducted on an one-hour cyclic basis at a temperature of 130° C., five times in succession.

SUMMARY OF THE INVENTION

Accordingly, it is an object of the present invention to provide a blow-by gas-recirculating device for an internal combustion engine which provides ease of manufacture and retains desired sealing performance, particularly in its operation at a high temperature.

It is another object of the present invention to provide a blow-by gas-recirculating device of the type described, in which an inlet pipe to be fitted to a heat-insulating member is bent to a desired bend radius prior to joining the inlet pipe to the heat-insulating member.

It is still another object of the present invention to provide a blow-by gas-recirculating device which avoids use of an insert-molding process for securing the inlet pipe in the heat-insulating member and minimizes or eliminates any tendency to develop cracks along the bonding interface fixing the inlet pipe and heat-insulating member one to the other.

Additional objects and advantages of the invention will be set forth in part in the description which follows, and in part will be obvious from the description or may be learned by practice of the invention. The objects and advantages of the invention may be realized and attained by means of the instrumentalities and combinations particularly pointed out in the appended claims.

To achieve the foregoing objects and in accordance with the purpose of the present invention, as embodied and broadly described herein, the blow-by gas-recirculating device for use in an engine having a blow-by gas producing source and an intake system comprises an inlet pipe for receiving the gas from the gas-producing source and communicating the gas to the intake system for the engine, a member formed of heat-insulating material and having at least one through-opening forming part of the intake system, means forming part of the member defining an inlet-pipe-admitting hole extending from an outer surface of the member to the peripheral surface of the one through opening in the member, the inlet pipe being positioned within the inlet-pipe-admitting hole in the member, and an adhesive for securing the inlet pipe and the member one to the other, the inlet pipe being formed of a metal having a coefficient of linear expansion no less than $16.7\times10^{-6}$/deg., and a modulus of longitudinal elasticity no more than 12980 kg/mm$^2$.

Thus, according to the present invention, there is provided a blow-by gas-recirculating or returning device, which includes an inlet pipe leading to an intake passage for an engine and a heat-insulating member, into which the inlet pipe is rigidly fitted and secured by an adhesive. As embodied herein, the inlet pipe leads from a blow-by gas-producing source via a positive crank case ventilation pipe to an intake passage running through the heat-insulating member positioned between a carburetor and an intake manifold. The heat-insulating member preferably has two intake through-holes which form part of an intake passage for the engine, in addition to an inlet-pipe-admitting hole, which extends from the outer side-surface of the heat-insulating member to the peripheral surface of one of the aforenoted intake through-holes in the heat-insulating member. In accordance with the invention, the inlet pipe has an average coefficient of linear expansion of no less than $16.7\times10^{-6}$/deg. in a temperature range of −20° to 200° C., and a modulus of longitudinal elasticity of no more than 12980 kg/mm$^2$, and is rigidly positioned in the inlet-pipe-admitting hole with the aid of an adhesive. A blow-by gas-producing source may be a crank case or a cylinder head cover. In the latter case, however, a positive crank-case ventilating pipe connects the cylinder head to the intake system for the engine.

The accompanying drawings, which are incorporated in and constitute a part of this specification illustrate a preferred embodiment of the present invention and, together with the specification, serve to explain the principles of the invention.

DESCRIPTION OF THE PREFERRED EMBODIMENT

Figure 1:
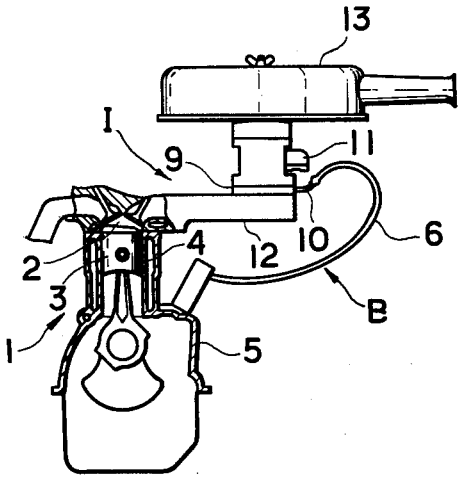
FIG. 1 is a schematic view with parts in cross section illustrative of a blow-by gas-recirculating device.

Referring now to FIG. 1, there is illustrated a blow-by gas-recirculating or returning device generally designated B. Blow-by gas from a combustion chamber 2 in an automotive engine, generally designated 1, communicates through a clearance space defined between a piston 3 and a cylinder 4 into a crank case 5 and is then directed via a positive crank case ventilation pipe 6 into the intake system for the engine, the intake system being generally designated I. The positive crank case ventilation pipe 6, in general, comprises a rubber hose.

The blow-by gas-producing source may alternatively comprise a cylinder head cover. However, in that case, the positive crank case ventilation pipe 6 connects the cylinder head cover to the intake system I for the engine.

The positive crank case ventilation pipe 6 is connected to an inlet pipe 10 connected to a heat-insulating member 9 which forms part of the engine intake system I. Thus, in accordance with the invention, there is provided an inlet pipe for receiving the gas from the gas-producing source and communicating the gas to the intake system. Heat-insulating member 9 is positioned between a carburetor 11 and an intake manifold 12 and between gaskets 7, 8, respectively, all of which additionally form part of the engine intake system I. The blow-by gas thus returned to the intake system through inlet pipe 10 is mixed with air from an air cleaner 13 and fuel from carburetor 11 for delivery to combustion chamber 2. Heat-insulating member 9 serves to prevent the heat transfer from intake manifold 12 to carburetor 11, which manifold may possibly obtain temperatures as high as 130° C. or more.

Heat-insulating member 9 is molded according to a plastic molding process by using a material, for example, consisting essentially of 50% by weight phenol resin, 30% by weight glass fibers; 10% by weight asbestos, 8% by weight hardener, and 2% by weight parting agent. The glass fibers contained therein serve to ensure the desired strength for member 9, while the asbestos ensures the desired heat-resisting characteristic. Thus, heat-insulating member 9 may withstand temperatures over 130° C.

Heat-insulating member 9 is generally flat and rectangular in shape. Member 9 has at least one through-opening forming part of the intake system but preferably has two through-openings 14, 15 extending vertically relative to the top and bottom generally planar surfaces thereof. In this embodiment, heat insulating member 9 is applied to a double-barrel type carburetor. Through-hole 14 defines part of a primary-side intake passage, while through-hole 15 defines part of a secondary-side intake passage.

Figure 3:
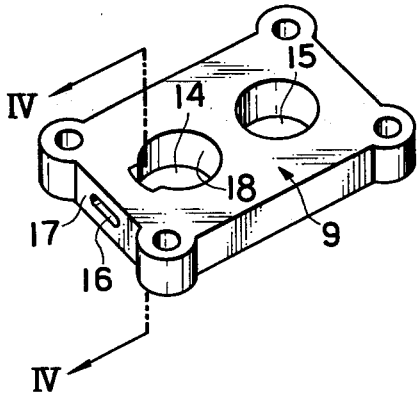
FIG. 3 is a perspective view of the heat-insulating member illustrated in FIG. 2.
Figure 4:
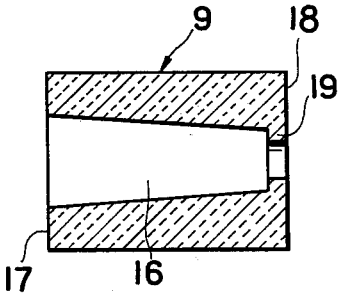
FIG. 4 is a cross-sectional view thereof taken generally about the line IV—IV of FIG. 3.

In accordance with the invention, means forming part of the member define an inlet-pipe-admitting-hole extending from an outer surface of the member to the peripheral surface of one of the through-openings in the member. As embodied herein, an inlet-pipe-admitting or receiving hole or aperture 16 extends through heat-insulating member 9 in the radial direction of the holes 14 and 15, e.g., from the outer side-surface 17 of member 9 to a peripheral surface 18 defining through-hole 14 therein. As illustrated in FIGS. 3 and 4, hole 16 has a width greater than its height and tapers inwardly toward intake through-hole 14 so that the open cross-sectional area thereof decreases in a direction from outer side-surface 17 toward the peripheral surface 18. A turned-in flange or annular stepped portion 19 is formed having its inner surface flush with the peripheral side-surface 18, as shown. Inlet-pipe-receiving hole 16 is provided by a slide core, not shown, upon the molding of heat-insulating member 9.

In accordance with the invention, the inlet pipe is positioned within the inlet-pipe-admitting hole in the member. As embodied herein, inlet pipe 10 is inserted into hole 16 in the heat insulating member 9, until pipe 10 abuts flange 19. Accordingly, there is defined a clearance space between the peripheral surface of hole 16 and the outer peripheral surface of inlet pipe 10. In this respect, the cross-sectional area of the clearance space thus defined is decreased in the direction from outer side-surface 17 towards flange 19. A heat-resisting adhesive 22 is then poured in the clearance space, for securing inlet pipe 10 and member 9 one to the other. The flange 19 prevents the leakage of adhesive 22 into the intake through-hole 14. Adhesive 22 may comprise an epoxy-resin and a silica gel serving as a filler agent. Preferably the adhesive is sold by Cemedine Co., Ltd. in the trade name of Great EP108.

In accordance with the invention, the inlet pipe is formed of a metal having a coefficient of linear expansion of no less than $16.7\times10^{-6}$/deg., and a modulus of longitudinal elasticity of no more than 12980 kg/mm$^2$. These properties of the inlet pipe are given for a temperature range of 20° to 200° C. Included among the metals employable for this purpose in the present invention are aluminum and its alloys, (1000,2000,3000,5000,6000,7000 systems according to the Japanese Industrial Specification), and copper and its alloys.

Figure 2:
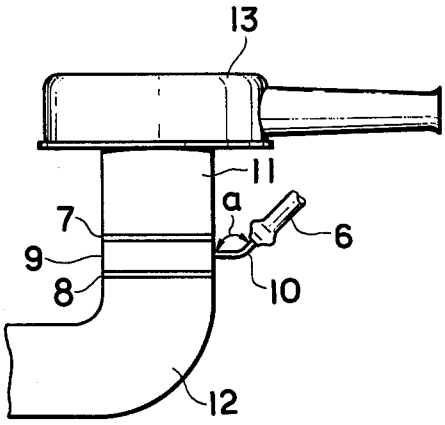
FIG. 2 is an enlarged fragmentary view illustrative of the manner of attachment to the engine intake system of a blow-by gas-recirculating device according to the present invention.
Figure 5:
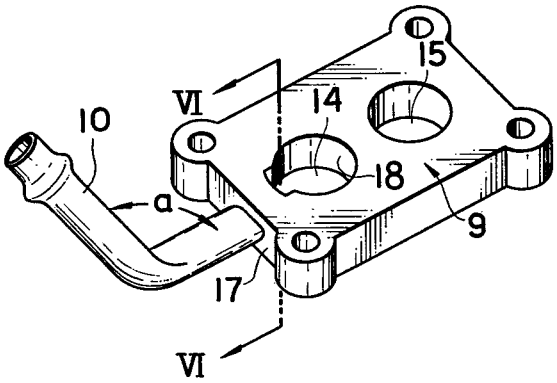
FIG. 5 is a perspective view of the heat-insulating member equipped with an inlet pipe, according to the present invention.
Figure 6:
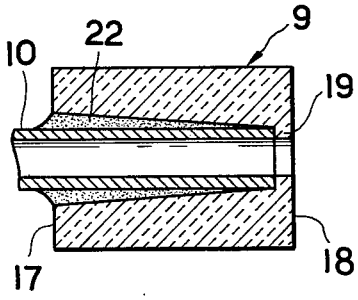
FIG. 6 is a cross-sectional view taken generally about the line VI—VI of FIG. 5.

Inlet pipe 10 has a bend as shown in FIGS. 2 and 5. The radius (a) of the bend of inlet pipe 10 is predetermined and selected in the bending operation prior to joining pipe 10 and heat-insulating member 9 one to the other.

Thermal shock tests were given to heat insulating members 9 having inlet pipes 10 formed of copper having a coefficie ıt of linear expansion ($\alpha$) of $16.7\times10^{-6}$/deg., and a modulus of longitudinal elasticity (E) of 12980 kg/mm$^2$, brass having a coefficient of linear expansion ($\alpha$) of $19\times10^{-6}$/deg., and a modulus of longitudinal elasticity (E) of 7030 kg/mm$^2$, and aluminum or aluminum alloy having a coefficient of linear expansion ($\alpha$) of $23\times10^{-6}$/deg., and a modulus of longitudinal elasticity (E) of 7030 kg/mm$^2$ respectively. The results of these tests reveal that heat-insulating member 9 having an inlet pipe 10 according to the present invention may withstand temperatures of 130° C. and higher. In contrast, heat-insulating members having an inlet pipe made of steel having a coefficient of linear expansion ($\alpha$) of $11.7\times10^{-6}$/deg., and a modulus of longitudinal elasticity (E) of 21000 kg/mm$^2$ produces a thermal stress which overcomes the bonding strength of the adhesive in the aforenoted thermal shock tests, resulting in cracking in the adhesive-filled portion of the heat-insulating member.

As is apparent from the foregoing description of heat-insulating member 9, inlet pipe 10 thus has a coefficient of linear expansion very comparable with that of heat-resisting adhesive 22, so that cracking does not result in the adhesive-filled portion of member 9 at high operational temperatures. Consequently, the desired sealing condition is established and maintained for both the heat insulating member and the inlet pipe.

In addition and advantageously, heat-insulating member 9 and inlet pipe 10 are not formed according to prior insert-type molding processes, but may be manufactured by using an adhesive. Thus, the need to use an inlet pipe which has been prepared or machined, with high accuracy, is avoided.

Further, a limitation has been imposed on the radius (a) of the bend of inlet pipes 10 previously constructed according to insert-type molding processes, because the pipe was required to be inserted into a metal mold. The radius (a) of the bend of inlet pipe 10, however, may be suitably selected as desired and without limitation.

The invention may be embodied in other specific forms without departing from the spirit or essential characteristics thereof. The present embodiment is therefore to be considered in all respects as illustrative and not restrictive, and all changes which come within the meaning and range of equivalency of the claims are therefore intended to be embraced therein.

What is claimed and desired to be secured by United States Letters Patent is:

1. A blow-by gas-recirculating device for use in an engine having a blow-by gas-producing source and an intake system, comprising:

an inlet pipe for receiving the gas from the gas-producing source and communicating the gas to the intake system, a member formed of heat-insulating material and having at least one through-opening forming part of the intake system, means forming part of said member defining an inlet-pipe-admitting hole extending from an outer surface of said member to the peripheral surface of said one through-opening in said member, said inlet pipe being positioned within said inlet-pipe-admitting hole in said member, and an adhesive for securing said inlet pipe and said member one to the other, said inlet pipe being formed of a metal having a coefficient of linear expansion no less than $16.7\times10^{-6}$/deg., and a modulus of longitudinal elasticity no more than 12980 kg/mm$^2$.

2. A blow-by gas-recirculating device according to claim 1 in combination with the blow-by gas-producing source, said source comprising the crank case of the engine.

3. A blow-by gas-recirculating device according to claim 1 in combination with the blow-by gas-producing source, said source comprising a cylinder head cover, said communicating means including an intermediate pipe connecting said cylinder head cover to the intake system for the engine.

4. A blow-by gas-recirculating device according to claim 1, wherein said inlet pipe is bent to a predetermined radius prior to positioning said pipe in said inlet-pipe-admitting hole, the peripheral surface of said inlet-pipe-admitting hole and the outer peripheral surface of said inlet pipe when inserted into said hole defining a clearance therebetween, said adhesive being provided in said clearance to secure said inlet pipe and said member one to the other.

5. A blow-by gas-recirculating device according to claim 1 wherein the peripheral surface of at least part of said inlet-pipe-admitting hole is tapered, and wherein a flange is carried by said member between the tapered hole part and said through-opening, said flange having an aperture therethrough forming the remaining portion of said inlet-pipe-admitting hole, said aperture lying at the smaller end of the tapered hole part.

6. A blow-by gas-recirculating device according to claim 1 wherein said member has a second through-opening forming part of the intake system, said second through-opening being disposed adjacent the first mentioned opening.

7. A blow-by gas-recirculating device according to claim 4 wherein the peripheral surface of at least part of said inlet-pipe-admitting hole is tapered, and wherein a flange is carried by said member between the tapered hole part and said through-opening, said flange having an aperture therethrough forming the remaining portion of said inlet-pipe-admitting hole, said aperture lying at the smaller end of the tapered hole part, said member having a second through-opening forming part of the intake system and adjacent the first mentioned opening.

* * * * *